US005462098A

United States Patent [19]

Murakami

[11] Patent Number: 5,462,098

[45] Date of Patent: Oct. 31, 1995

[54] AUTOMATIC TIGHTENER

[76] Inventor: Saburo Murakami, 11-3-1115, Shimono-cho 2-chome, Kishiwada-shi, Osaka, Japan

[21] Appl. No.: 147,064

[22] Filed: Nov. 3, 1993

[30] Foreign Application Priority Data

Oct. 17, 1991 [JP] Japan ..... 3-269621

[51] Int. Cl.[6] ..... B21F 15/04

[52] U.S. Cl. ..... 140/119; 140/93 A

[58] Field of Search ..... 140/57, 93.69, 140/118, 119, 93 A

[56] References Cited

U.S. PATENT DOCUMENTS

| | | | |
|---|---|---|---|
| 1,242,353 | 10/1917 | Kuhn et al. | 140/119 |
| 1,306,163 | 6/1919 | Bates | 140/119 |
| 1,341,459 | 5/1920 | Foulder | 140/119 |
| 1,975,110 | 10/1934 | Louckes | 140/118 |
| 3,114,399 | 12/1963 | Hamilton et al. | 140/93.2 |
| 3,273,605 | 9/1966 | Ferrara, Jr. | 140/119 |
| 3,970,117 | 7/1976 | Zamansky et al. | 140/57 |
| 4,900,202 | 2/1990 | Wienhold | 279/905 |
| 5,279,336 | 1/1994 | Kusakari et al. | 140/57 |
| 5,339,869 | 8/1994 | Hayakawa | 140/57 |

*Primary Examiner*—Lowell A. Larson
*Attorney, Agent, or Firm*—Tarolli, Sundheim & Covell

[57] ABSTRACT

An automatic tightener is provided. The tightener comprises a tightening member and means for driving said tightening member. The tightening member includes a hook portion for engaging within a loop of binding wire. The tightening member, when rotated, tightens the binding wire so as to bind adjacent reinforcing bars together by the binding wire. The driving means includes an electric motor which is powered with a rechargeable battery.

2 Claims, 3 Drawing Sheets

AUTOMATIC TIGHTENER

FIELD OF THE INVENTION

This invention generally relates to an automatic tightener for binding wires, and more particularly to an automatic tightener which may be effectively used in binding together reinforcing bars for concrete poles or buildings with binding wires.

DESCRIPTION OF THE PRIOR ART

As shown in FIG. 4, it is known that reinforcing bars 2 for buildings 1 or the like are bound together with binding wires 3. Conventionally, such binding wires have been tightened by means of a tightening tool 5 shown in FIG. 6. The tightening tool 5 includes a shank or shaft portion 6 and a hook portion 7 connected to the distal end of the shank portion 6 for engaging binding wires 3.

In operation, the tool 5 is held by its shank portion 6 and driven manually so that the binding wire 3 engaged by the hook portion 7 is rotated in unison with the hook portion so as to be tightened, whereby adjacent reinforcing bars 2, 2 are bound together.

Prior art tightening tool is operated or driven manually as described above. Accordingly, such a conventional tool is disadvantageous in that it makes tightening work wearisome and tiresome.

SUMMARY OF THE INVENTION

Accordingly, it is a main object of the invention to provide an automatic tightener which eliminates the above disadvantages experienced in prior art and which is advantageous in practice.

In order to achieve the above object, the present invention provides an automatic tightener which comprises a tightening member for engaging a wire and means for driving the tightening member.

In operation, the tightening member is rotated around the longitudinal axis thereof by means of the driving means so as to tighten a wire.

BRIEF DESCRIPTION OF THE DRAWINGS

For a better understanding of the invention, and to show how the same may be carried into effect, reference will now be made, by way of example, to the accompanying drawings in which like reference numerals refer to like elements.

DETAILED DESCRIPTION OF PREFERRED EMBODIMENTS

The invention will be explained in detail below with reference to FIGS. 1 through 3.

Figure 1:
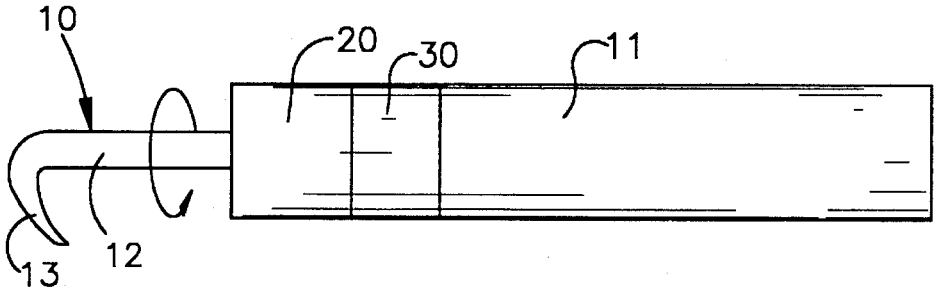
FIG. 1 is a schematic side elevational view of an automatic tightener according to one embodiment of the invention.

With reference to FIG. 1, an automatic tightener 10 according to one embodiment of the invention comprises a tightening member 10 and a drive unit 11 for driving or rotating the tightening member 10. The tightener also includes a chuck 20 for securing the tightening member 10 thereto and a gear portion 30 for transmitting a rotational force from the drive unit 11 therethrough and through the chuck to the tightening member 10.

Figure 4:
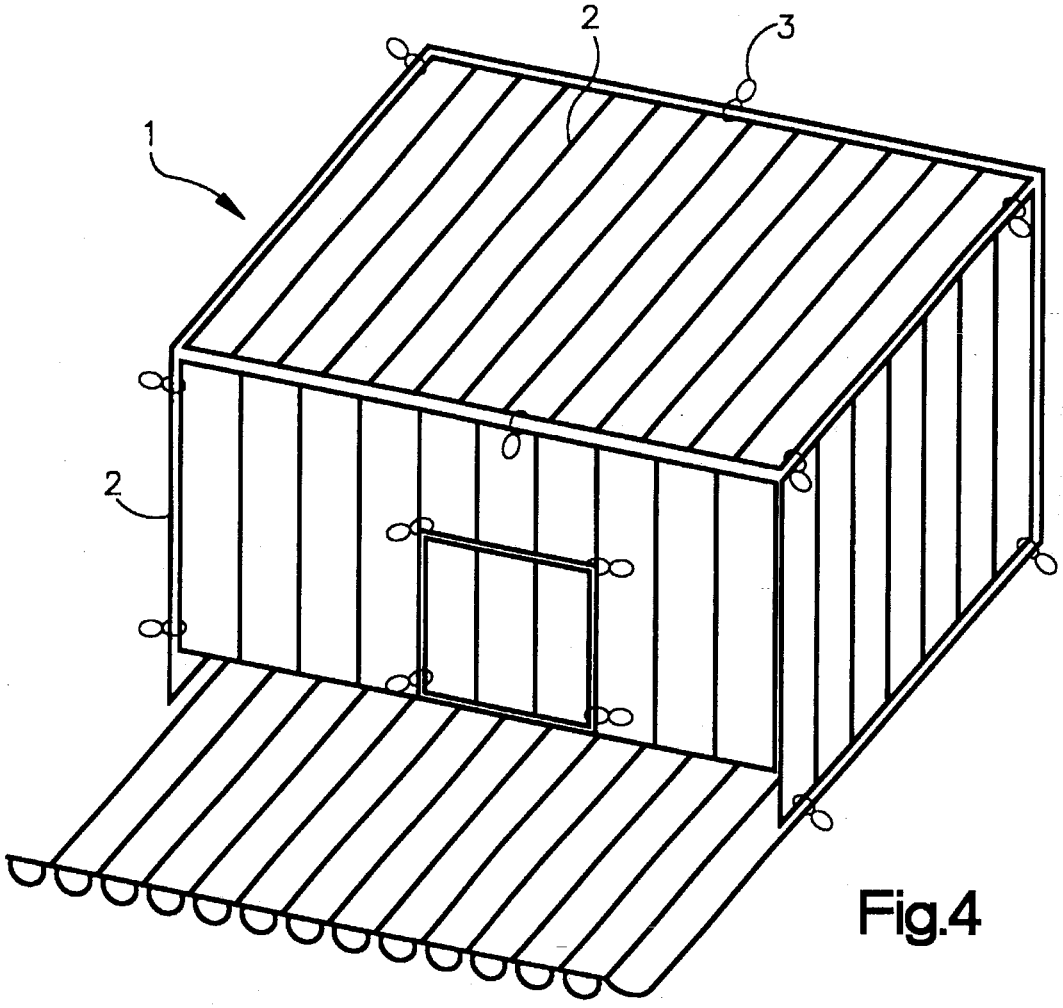
FIG. 4 is a schematic perspective view of a framework consisting of reinforcing bars bounded with wires.
Figure 5:
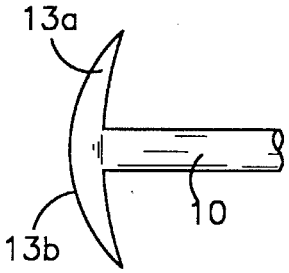
FIG. 5 is a partial view showing another embodiment of the tightening member.
Figure 6:
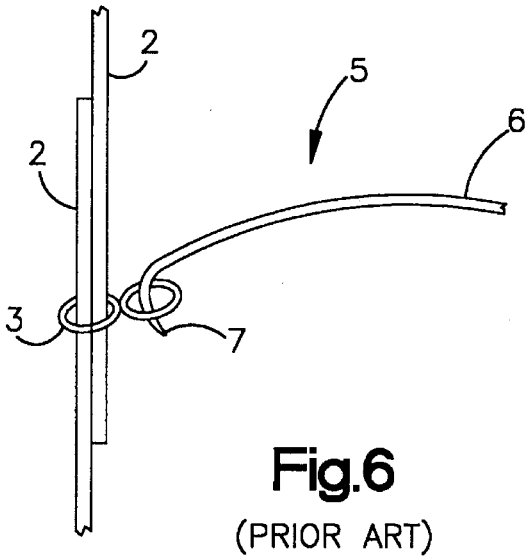
Fig.6 (PRIOR ART)
FIG. 6 is a diagrammatic illustration showing a pair of reinforcing bars bound with a binding wire which is tightened by means of prior art tightening tool.

The tightening member 10 includes a generally straight shank or shaft portion 12 and a hook portion 13 for engaging a binding wire 3 (FIGS. 4 and 5). The tightening member 10 also includes an attachment portion at one end thereof opposite from the hook portion 13. The attachment portion is inserted into the chuck so as to secure the tightening member to the chuck.

Preferably, the attachment portion and chuck are designed so that they may be operably engaged or connected together with a one-touch operation, as will be explained later in detail.

Figure 2:
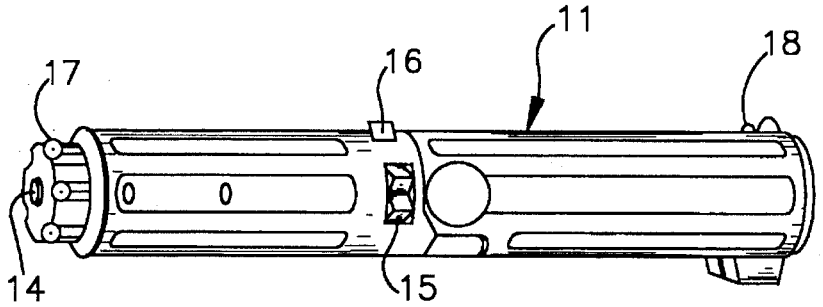
FIG. 2 is a perspective view of driving means or drive unit of the automatic tightener of FIG. 1.

FIG. 2 illustrates a typical example of the drive unit 11. The drive unit 11 includes a drive shaft 14 designed to be connectable with an input to the gear portion 30. The drive unit 11 also includes a motor (not shown in FIG. 2) for rotationally driving the drive shaft. The motor, in the illustrated embodiment, is powered with a rechargeable battery. The motor could also be powered with a single or plurality of non-rechargeable batteries or A.C. power source. In FIG. 2, reference numeral 15 designates an ON/OFF switch, 16 a locking switch, 17 a torque gauge, and 18 a lamp for indicating completion of charging.

Figure 7:
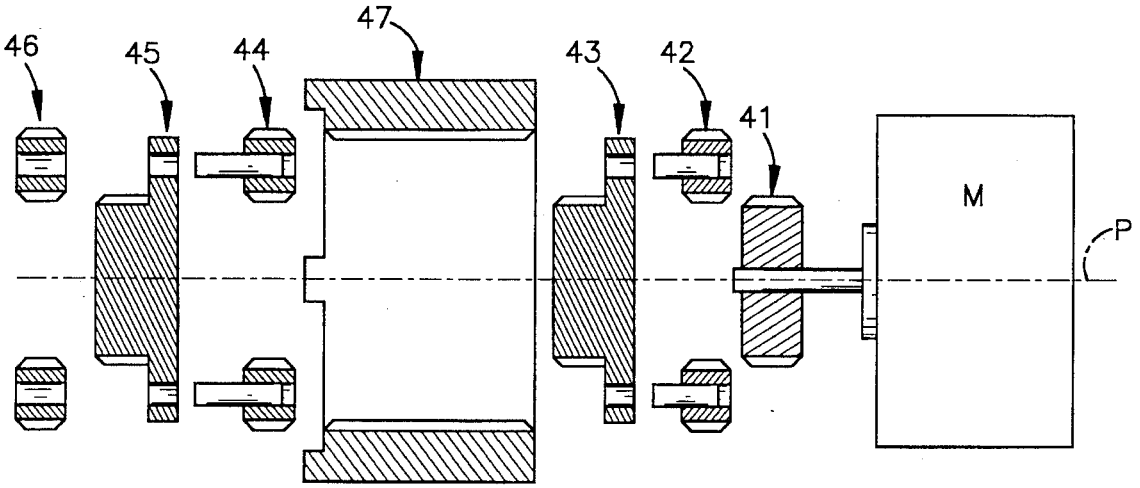
FIG. 7 is a schematic view of a planetary gear mechanism.

Referring to FIG. 7, a planetary gear mechanism is schematically illustrated. Numeral 41 denotes a gear attached to the output shaft of a motor M. The gear 41 rotates about the axis P during running of the motor M.

Numeral 42 denotes a respective planetary gear. These three planetary gears 42 (only two of which are shown in FIG. 7) are rotated about their own axis by means of a rotational motion from the gear 41. The planetary gear 42 also revolve around the gear 41.

Numeral 43 denotes a bearing plate. The axle of each of the planetary gears 42 is inserted into a respective hole in the bearing plate 43. Thus, the bearing plate 43 is rotated about the axis P when the planetary gears revolve around the axis P. The bearing plate 43 has no teeth in its outer periphery.

Numeral 44 denotes a respective planetary gear. These three planetary gears 44 (only two of which are shown in FIG. 7) rotate about their own axis. The planetary gears also revolve around the axis P.

Numeral 45 denotes a bearing plate. The axle of each of the planetary gears 44 is inserted into a respective hole in the bearing plate 45. The revolutional movement of each of the planetary gears 44 around the axis P is transmitted to the bearing plate 45. Thus, the bearing plate rotates about the axis P. The bearing plate 45 has no teeth in its outer periphery.

Numeral 46 denotes a respective planetary gear. These three planetary gears 46 (only two of which are shown) are rotated by the bearing plate 45, so that they rotate about their own axis and revolve around the axis P.

Numeral 47 denotes a gear box which houses therein the planetary gears 44 and 46, and bearing plate 45. The gear box 47 has internal teeth in its inner periphery. The planetary gears 44 and 46 are always meshed with the internal teeth of the gear box 47.

Figure 8:
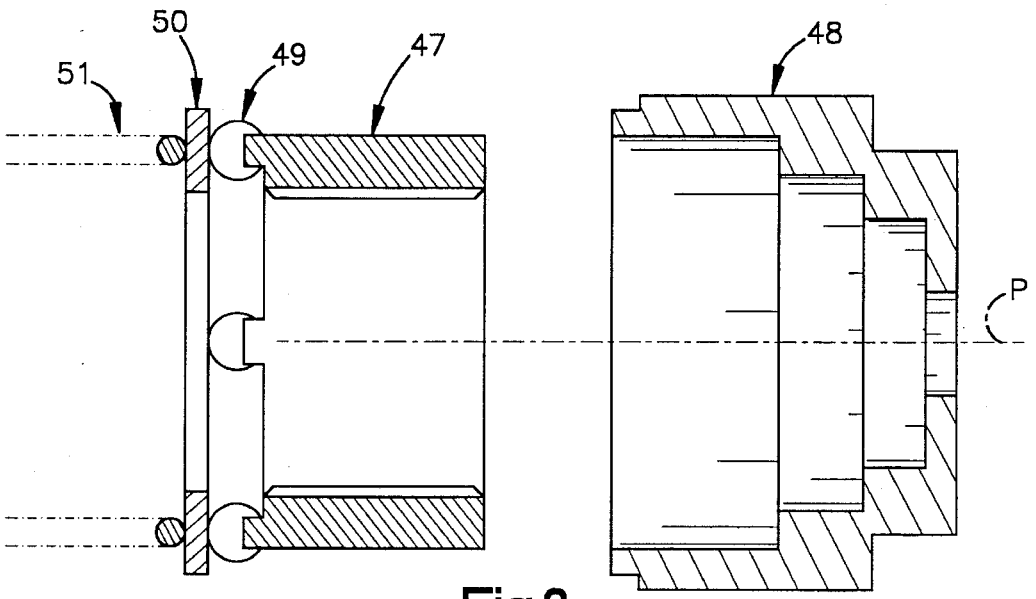
FIG. 8 is a schematic view of a clutch mechanism.

Referring to FIG. 8, a clutch mechanism is schematically illustrated. Numeral 48 denotes a casing (of a plastic resin). The gear box 47, gear 41, planetary gears 42, and bearing plate 43 are all housed in the casing 48.

Numeral 49 denotes a plurality of balls of steel. These balls 49 are always urged against the gear box 47 by means of a spring 51 through a slip plate 50. The force urging the balls may be adjusted by changing the degree of compression of the spring 51.

When a torque above a predetermined torque occurs, i.e., when an over-torque is applied to the bit (tightening member), the balls 49 override the lugs of the gear box 47. Thus, the gear box 47 becomes to be rotated independently, so as to prevent any rotation and/or revolution of the planetary gears 44, bearing plate 45, and the planetary gears 46. Consequently, no rotational movement is transmitted from the gears 46.

Figure 9:
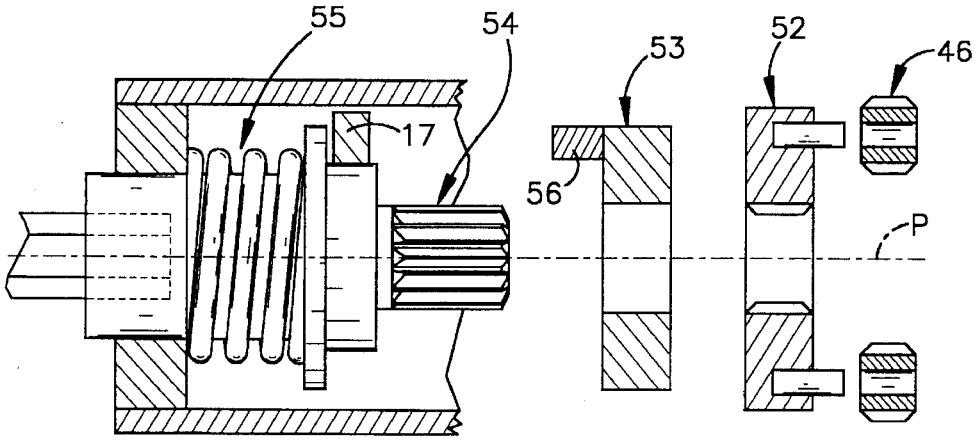
FIG. 9 is a schematic view of a mechanism for stopping a tightening member at a predetermined position.

Referring to FIG. 9, a mechanism for stopping a tightening member at a predetermined position is schematically illustrated.

Numeral 52 denotes a bearing plate. The bearing plate 52 is rotated about the axis P by means of the revolutional movement of the planetary gears 46 around the axis P. The bearing plate 52 has internal teeth in its inner periphery.

Numeral 53 denotes a plate provided with a lug 56 serving as a stopper. The plate 53 is secured to the casing 48 so as to temporarily cause an over-torque to thereby activate the clutch mechanism.

Numeral 54 denotes a body to which the bit or tightening member is attached. The body 54 has exterior teeth in meshing engagement with the inner bore of the bearing plate 52 and has a lug 57. The body 54 is always urged toward the plate 53 by means of a spring 55. In this state, the lug 57 of the plate 53 and the lug 56 of the body 54 are engaged with each other so as to stop relative rotation between the plate 53 and the body 54. Thus, the clutch is actuated and no rotational motion is transmitted.

It is noted that rotational motion may be transmitted when the lugs are released from one another by pulling the bit or tightening member.

The clutch mechanism, as shown in FIG. 8, prevents transmission of a driving force above a predetermined amount from the means for rotationally driving the tightening member to the tightening member when a torque above a predetermined amount, i.e., an over-torque, is applied to the tightening member. Thus, possible breakage of binding wires and/or damage of the driving motor, due to an over-torque, may be prevented. The use of a planetary gear mechanism, as shown in FIG. 7, permits a high reduction-ratio, and therefore a high output-torque, to be transmitted to the tightening member.

It should be noted that the present invention will not be limited to the use of the above drive unit 11.

Figure 3:
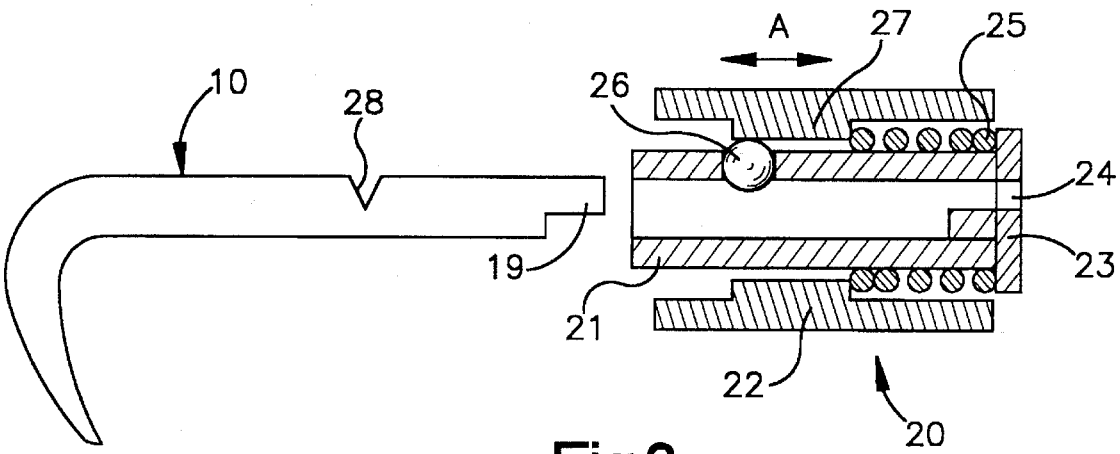
FIG. 3 is a cross-sectional view of a chuck or connector for securing thereto a tightening member.

With reference to FIG. 3 in which is shown a preferred embodiment of chuck 20. This chuck is designed to allow attachment or securement of the tightening member 10 thereto with a one-touch operation.

The chuck 20 includes a hollow, cylindrical inner and outer casings 21 and 22 and a hub 23. The hub 23 is driven by means of the gear portion 30 for rotation relative to the casings 21 and 22. The hub 23 includes a bore 24 for receiving therein an attachment portion 19 of the tightening member 10. The bore 24 of the hub 23 and the attachment portion 19 of the tightening member 10 are configured so that the tightening member 10 will rotate in unison with the hub 23 when the latter is driven by the gear portion 30.

The outer casing 22 receives therein the inner casing 21 in a manner that the outer casing 22 may be slidable along the longitudinal axis of the casings in a direction of A (FIG. 3). The outer casing 22 is usually urged so as to be pushed away from the hub 23 by means of a compression spring 25. A ball 26 is received in an aperture formed through the wall of the inner casing 21 in a manner that it will not be dislodged downwardly from the aperture.

When the outer casing 22 is displaced toward the hub 23 so as to permit the ball 26 to be released from a shoulder portion 27 formed in the inner wall of the outer casing 22, the tightening member 10 may be inserted into the chuck 20 so as to position the attachment portion 19 received within the bore 24 of the hub 23. At this time, the ball 26 is received within a groove 28 formed in the circumference of the tightening member 10. Then, the outer casing 22, when released, is returned to its normal position due to the repulsing force exerted by the compression spring 25. This causes the ball 26 and groove 28 to be securely engaged or meshed, whereby the tightening member 10 is firmly retained in the chuck 23, as will be appreciated by one having ordinary skill in the art.

In FIG. 5, the tightening member 10 includes opposed hook portions **13*a* and 13*b*. Each of the hook portions 13*a* and 13*b* is engageable with the binding wire 3**. The number of the hook portions may be selected as occasion demands.

In operation, the hook portion 13 is inserted into a loop formed by a wire. Then, the motor is energized to rotate the tightening member 10 so as to tighten the wire.

It will be appreciated by one having ordinary skill in the art that the present invention provides a labor saving machine for effecting binding work of reinforcing bars.

The principles, preferred embodiments and modes of operation of the present invention have been described in the foregoing specification. The invention which is intended to be protected herein should not, however, be construed as being limited to the particular form described as it is to be regarded as illustrative rather than restrictive. Variations and changes may be made by those skilled in the art without departing from the spirit of the present invention. Accordingly, the foregoing detailed description should be regarded as being exemplary in nature and not as limiting to the scope and spirit of the invention set forth in the appended claims.

What is claimed is:

1. An automatic tightener for tightening binding wires comprising: a tightening member for engaging binding wires, drive means for rotationally driving said tightening member, a clutch mechanism disposed between said tightening member and said drive means for preventing transmission of the driving force from said drive means to said tightening member when a torque above a predetermined amount is applied to said tightening member, a mechanism for stopping said tightening member at a predetermined position during rotation of said tightening member in a tightening direction, a housing portion, and a rotatable portion which is rotatable relative to said housing portion upon rotation of said tightening member, said mechanism for stopping including a first lug means connected to said housing portion for providing a stopping surface, a second lug means connected to said rotatable portion for rotation with said rotation portion and for engaging said first lug means when said tightening member is moved to the predetermined position, said second lug means being axially moveable relative to said first lug means for permitting said second lug means to rotate past said first lug means without engaging said first lug means and a bias means for axially biasing said second lug means toward said first lug means, said bias means being overcome by an axial force applied by an operator during the tightening of the wires.

2. An automatic tightener according to claim 1, wherein said bias means being a spring.

* * * * *